US007665619B2

(12) United States Patent
Mangano

(10) Patent No.: US 7,665,619 B2
(45) Date of Patent: Feb. 23, 2010

(54) MODULAR SHELF SYSTEM

(75) Inventor: Joy Mangano, St. James, NY (US)

(73) Assignee: Ingenious Designs LLC, Edgewood, NY (US)

( * ) Notice: Subject to any disclaimer, the term of this patent is extended or adjusted under 35 U.S.C. 154(b) by 446 days.

(21) Appl. No.: 11/519,093

(22) Filed: Sep. 12, 2006

(65) Prior Publication Data

US 2008/0023427 A1 Jan. 31, 2008

Related U.S. Application Data

(63) Continuation-in-part of application No. 11/493,641, filed on Jul. 27, 2006, now abandoned.

(51) Int. Cl.
*A47F 5/00* (2006.01)

(52) U.S. Cl. ..... 211/187

(58) Field of Classification Search ..... 211/187, 211/103, 192, 191, 90.02, 190, 90.04, 207, 211/193, 204, 206; 108/108, 147.11, 147.17; 248/241, 243, 235, 250

See application file for complete search history.

(56) References Cited

U.S. PATENT DOCUMENTS 1,698,974 A * 1/1929 Vance ..... 211/60.1
2,191,701 A * 2/1940 Wood ..... 248/245
2,464,743 A 3/1949 Evans et al.
2,937,766 A * 5/1960 Penn ..... 211/193
2,997,269 A * 8/1961 Urbain ..... 248/245
3,018,900 A * 1/1962 Huet ..... 211/193
3,172,539 A 3/1965 Rulf
3,281,102 A * 10/1966 Hobson ..... 248/125.3
3,371,466 A * 3/1968 Klopfenstein ..... 53/206
3,525,442 A * 8/1970 Novales ..... 211/193
3,854,686 A * 12/1974 Konstant ..... 248/243
4,064,996 A * 12/1977 Shillum ..... 211/191
4,396,125 A * 8/1983 Rowader ..... 211/193
4,444,323 A * 4/1984 Travis ..... 211/193
4,819,814 A 4/1989 Fogelgren
4,852,839 A * 8/1989 Winter et al. ..... 248/220.42
5,054,404 A * 10/1991 Melgers ..... 108/108
5,148,928 A 9/1992 Arnold
5,253,835 A 10/1993 Herron, III
5,354,025 A 10/1994 McCaffrey
5,477,789 A 12/1995 Von Gunten
5,605,238 A 2/1997 Jacobs
5,644,993 A 7/1997 Dohnalik
5,797,501 A 8/1998 Von Gunten
5,960,968 A * 10/1999 Wang ..... 211/187
RE36,669 E * 4/2000 Zilincar, III ..... 211/86.01

(Continued)

*Primary Examiner*—Jennifer E. Novosad
(74) *Attorney, Agent, or Firm*—Kenyon & Kenyon LLP

(57) ABSTRACT

A shelf system having stable shelf supports and a reduced profile when installed. The invention also allows various configurations to be achieved without the need of tools. A modular shelf unit according to an embodiment of the invention includes upright supports and support brackets configured to attach to the back portion of each upright support. The support brackets may mimic the outer surface of the upright support. The support brackets may also comprise a clip, opening, or other structure configured to support or connect to an additional component, such as a garment rod. The shelves may include openings at either end configured to receive the upright supports. Various lengths and depths of shelves may be used, allowing for customization of the shelving unit or system.

20 Claims, 12 Drawing Sheets

U.S. PATENT DOCUMENTS

| | | | | |
|---|---|---|---|---|
| 6,364,129 | B1 | 4/2002 | Dardashti et al. | |
| 6,375,202 | B2 * | 4/2002 | Weck et al. | 280/47.35 |
| 6,443,319 | B1 | 9/2002 | Sander | |
| 6,637,608 | B1 | 10/2003 | Schneider | |
| 6,666,344 | B1 | 12/2003 | Schneider | |
| D559,014 | S * | 1/2008 | Mangano | D6/479 |
| 7,314,143 | B1 * | 1/2008 | Johnson | 211/106 |
| 2003/0085191 | A1 * | 5/2003 | Nakajima | 211/186 |
| 2003/0226944 | A1 * | 12/2003 | Sode | 248/243 |
| 2005/0139562 | A1 * | 6/2005 | Chen | 211/187 |
| 2006/0118505 | A1 * | 6/2006 | Walter | 211/190 |

* cited by examiner

MODULAR SHELF SYSTEM

RELATED APPLICATIONS

This application is a continuation-in-part of U.S. application Ser. No. 11/493,641, filed Jul. 27, 2006 now abandoned, the disclosure of which is incorporated by reference in its entirety.

FIELD OF THE INVENTION

The present invention relates to modular shelving systems. These systems can include modular shelving systems having improved shelf support, stability, and assembly.

BACKGROUND

Various systems of modular shelving have been proposed. Generally, such systems include upright supports, shelf supports or brackets, and shelves that are supported by the brackets. Previous systems may be undesirable due to stability, installation, and/or assembly issues. For example, many systems may be unstable, such as when moved or unintentionally pushed from the front or sides. Many systems may also require the upright supports to be mounted to a wall, requiring permanent alteration to the shelf location and often requiring various tools for assembly. In configurations using cantilever brackets attached to the front of the supports, the shelves may be unsteady such as when the bracket is unintentionally moved. In some cases, additional support is given to the shelf unit by providing bases or other supports at the bottom of the upright supports. This may be undesirable, since it may prevent one unit from being placed adjacent to another, increasing the amount of space required for multiple units.

SUMMARY OF THE INVENTION

The present invention provides a shelf system having stable shelf supports and a reduced profile when installed. The invention also allows various configurations to be achieved without the need of tools.

A modular shelf unit according to an embodiment of the invention includes upright supports. In an embodiment, the supports are angled so that the top of each support may be placed against a wall. Similarly, the bottom of each support may be angled away from the wall, providing additional support and resistance to front-to-back movement.

Support brackets may be configured to attach to the back portion of each upright support. The support bracket may include a connector, sleeve or other surface to mimic the outer surface of the upright support, which may provide a stable and secure connection between the brackets and the upright support. Each support bracket may comprise a support beam extending from behind the upright support to the front, and configured to receive and support a shelf. The top edge of each support bracket may be angled slightly downward or upward from back to front, providing additional stability to the shelf. The support brackets may also comprise a clip, opening, or other structure configured to support or connect to an additional component, such as a garment rod. For example, two brackets connected to adjacent upright supports at the same height may have openings allowing opposite ends of a garment rod to be inserted.

Shelves may be disposed between the upright supports and on the top surface of the support brackets. The shelves may include openings at either end configured to receive the upright supports. Thus, a shelf may partially surround the upright supports at either end, providing stability and reducing the likelihood of shifting if a horizontal force is exerted on the shelf. Various lengths and depths of shelves may be used, allowing for customization of the shelving unit or system. For example, deep shelf may be disposed at a height appropriate for use as a desk surface, and narrower shelves may be disposed at various heights above the desk surface for storage. Other configurations including some or all of these features may be used.

The upright supports may be attached to or comprise a base at the bottom end. The base may provide additional front-to-back and/or side-to-side support. It is preferred that the base be narrow enough that two upright supports may be placed roughly adjacent. In some configurations, the upright supports may be placed at a distance allowing two adjacent shelves placed at the same height to provide a continuous surface.

DETAILED DESCRIPTION

Figure 1:
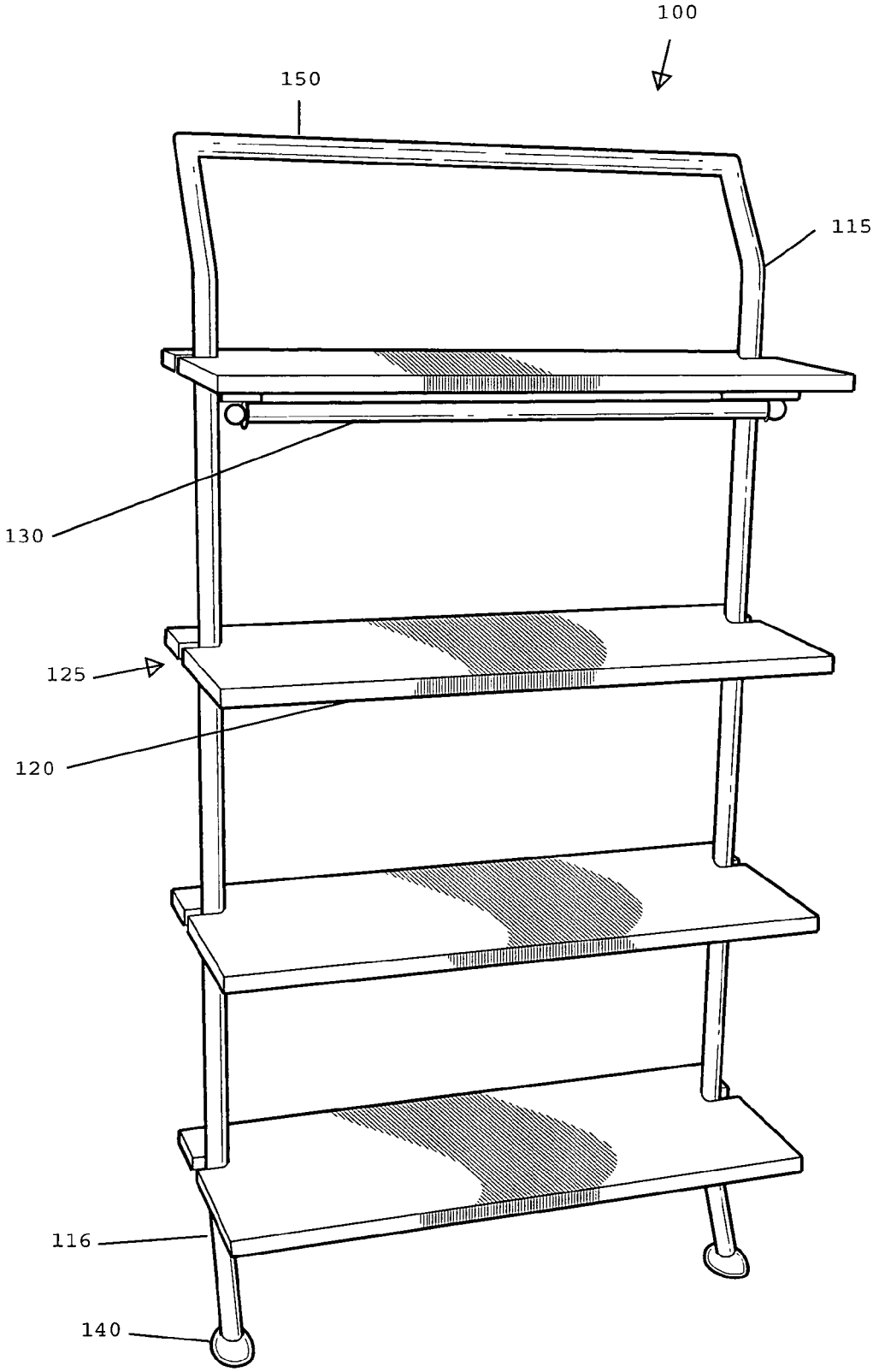
FIG. 1 shows a perspective view of a modular shelf unit according to an embodiment of the present invention.

FIG. 1 illustrates one configuration of a shelf unit 100 according to an embodiment of the present invention. Parallel upright supports 110 may be used to provide vertical support for the unit. The supports 110 may have angled bends 115, 116. An angled bend 115 near the top of the upright support may bend in the direction of a wall against which the unit is to be placed. That is, the upper bend 115 may be configured so that the portion of the upright support 110 above the angled bend is farther to the back of the unit 100 than the vertical portion of the upright support. This may allow the top portion of each of the upright supports 110 to be placed adjacent to and in contact with a wall for additional support. A lower angled bend 116 may bend in the opposite direction, i.e., toward the front of the unit, such that the lower-most portion of the upright supports 110 is positioned farther toward the front of the unit 100 than the vertical portions of the upright supports 110. The lower angled bend 116 may provide additional support for the unit. For example, by placing the portion of the upright supports below the lower bend 116 closer to the front of the unit, tipping or rocking of the unit may be reduced. The lower bend 116 may also result in additional force being transferred to the top portion of each upright support, providing additional force against the portion of the unit placed against a wall. The upright supports 110 may be comprised of a metal alloy or other material. The cross-sectional size of the upright may depend upon the material comprising the upright. For instance, if a steel alloy is used, the cross section may be smaller than if a polymer is used. Likewise, the cross-sectional profile of the upright may also be different. For example, it may have a circular cross-section as well as various other sectional dimensions, including a pentagon, a hexagon and semi-circle.

Shelf support brackets may be connected to the upright support via slots or other openings disposed along the back facing surface of each upright support. The support brackets may include a cantilevered support beam that may extend towards the front of the unit, along a substantial portion of the depth of the unit. The support brackets are described in further detail with respect to FIG. 2.

A plurality of shelves 120 may be placed on the shelf support brackets and between the upright supports 110. The shelves preferably have an opening 125 at each end, allowing the shelves to partially surround a region of each upright support 110. This may be preferable to provide increased stability to the shelves and reduce unintentional movement of the shelves, such as when positioning items on the shelves. The shelves may be the same dimensions, or various dimensions may be used. In an embodiment, each shelf has the same width and depth, providing uniform storage surfaces. In another embodiment, each shelf has the same width, but one or more shelves have various depths. For example, a shelf disposed at a height appropriate for use as a desk or table may have a greater depth than the other shelves in the unit, allowing the shelf to be used as a desk. Other configurations of shelf dimensions may be used.

Each upright support 110 may have a base 140 disposed at the bottom of the support. It is preferred that the base 140 be sufficiently narrow that one unit 100 may be placed adjacent to another unit 100, with a minimum of space between two shelves placed at equal heights on the two units. Thus, the base 140 may be configured such that it does not extend in the direction of the outer edge of the unit more than a distance equal to the amount by which the shelves extend past the upright support. For example, if the openings 125 at either end of the shelves 120 allow the shelves to extend past the upright support by 5 cm, it is preferable that the base not be wider than about 5 cm when measured from the center of the base to the outer edge of the unit. The base may also comprise a rubber or other polymer material in order to increase the amount of static friction between the shelving system and the floor that it is resting on. By increasing the amount of friction, the likelihood that the system will slip away from a wall is reduced.

In an embodiment, a horizontal member 150 may be disposed between the upright supports 110. The horizontal member 150 generally may be any shape. For example, it may be rod-shaped or arched to provide various appearances or support to the shelf unit. The horizontal member may be configured to rest against a wall and provide additional support when the shelf unit is placed near a wall.

In another embodiment, a garment rod 130 may be connected to two shelf supports placed at equal heights on the upright supports. Specific configurations of the garment rod 130 are discussed below.

In another embodiment, the various component of the shelf unit 100 may be assembled without the use of tools. For example, the portions of the upright support 110 above the upper bend 115 and below the lower bend 116 may be attached to the central portion of the upright support 110 by means of a hand-threaded bolt or other connector. The shelf support brackets and shelves may also be attachable by hand. This configuration may allow for more rapid and less error-prone assembly.

Figure 2A:
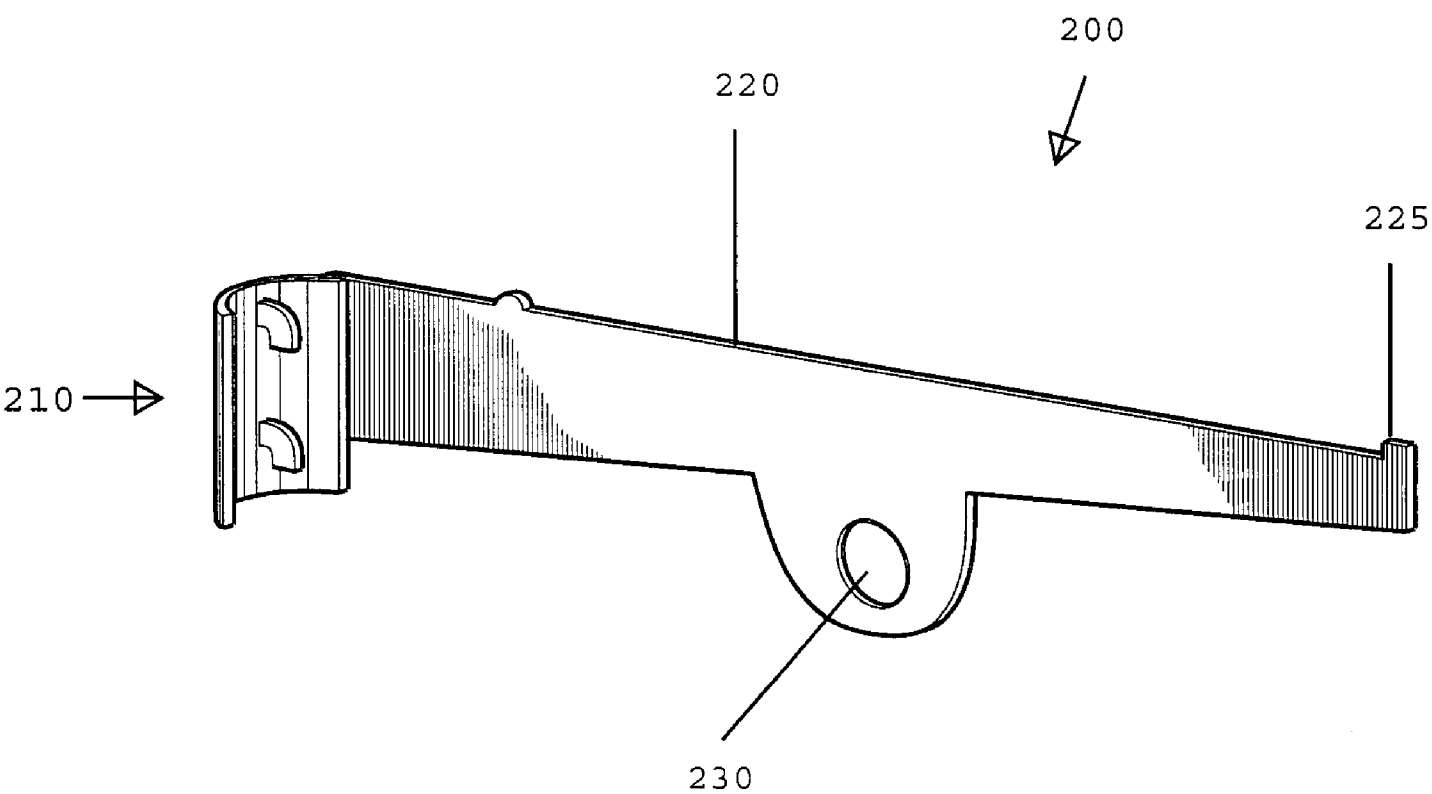
FIG. 2A shows a perspective view of a shelf support bracket according to an embodiment of the present invention.

FIG. 2A shows a perspective view of a shelf support bracket 200 according to an embodiment of the invention. The bracket comprises a connector 210 with an inner surface configured to rest approximately flush against the back surface of an upright support. For example, if the upright supports 110 described with respect to FIG. 1 are cylindrical, the inner surface of the connector 210 may be semi-cylindrical. One or more connection hooks 215 may be disposed on the inner surface of the connector, allowing the connector to be secured to one of the upright supports. The connection hooks 215 are preferably configured to prevent the support bracket 200 from being unintentionally disconnected from the upright support. A shelf support beam 220 extends from the connector 210. The shelf support beam 220 extends from the connector 210 toward the front of a shelf unit when the support bracket 200 is attached to an upright support. It is preferred that the support beam be configured perpendicular to the long axis of a shelf when connected to an upright support. In an embodiment, the support beam 220 may be angled slightly downward from back to front when the support bracket 200 is attached to an upright support. The configuration and positioning of the support bracket 200 is further described with reference to FIGS. 3A, 3B, and 4.

The shelf support bracket 200 may include one or more protrusions 225 extending from the shelf-supporting surface of the support beam. The protrusions 225 may be inserted into openings on the bottom of a shelf to be supported by the bracket 200, which may prevent unintentional movement of the shelf on the support brackets. For example, the protrusions may reduce side-to-side movement of a shelf placed on the support brackets.

The shelf support bracket 200 may further include an extension and/or opening 230 to receive an additional storage component, such as a garment rod. The opening 230 may be disposed within an extension of the support beam as shown in FIG. 2A, or it may be disposed within the support beam 220. For example, two shelf support brackets 200 may be attached to adjacent upright supports as described with respect to FIG. 1, where each support bracket includes an opening 230. A garment rod may then be disposed between the two support brackets, with one end disposed within the opening 230 of one of the support brackets, and the other end disposed within an opening 230 on the other support bracket. Additional clips or pins as are known in the art may be attached to each of the garment rod to prevent the garment rod from being unintentionally removed.

The connector portion of the support bracket 200 may be configured to exactly mimic the outer perimeter of the uprights. Thus, if the outer perimeter of the uprights is in the form of a pentagon, the connector 210 may also itself form three wall of the pentagon. Likewise, if the upright is it the shape of a hexagon, the connector 210 may have three sides that mimic the dimensions of the upright.

Figure 2B:
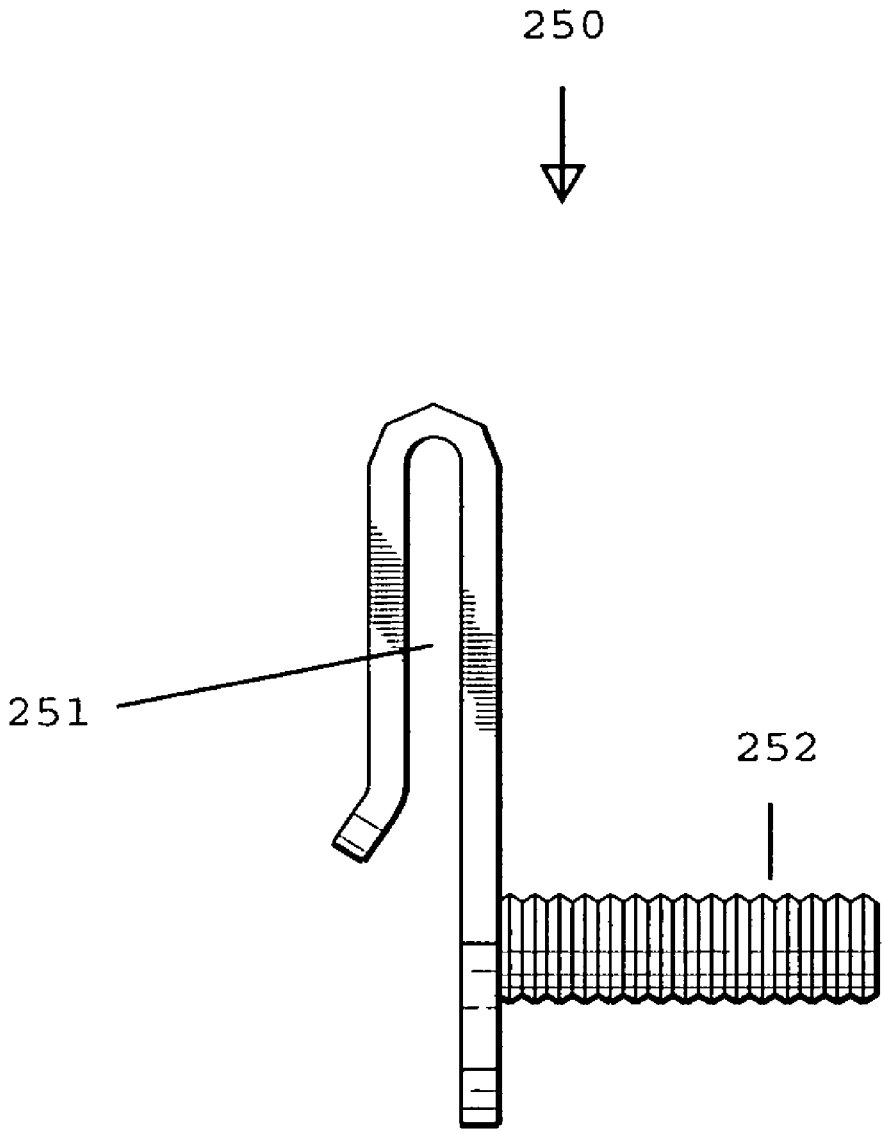
FIG. 2B shows a side schematic view of an extension clip according to an embodiment of the present invention.

FIG. 2B shows an extension clip 250 that may be attached to a shelf support bracket. The clip includes a securing portion 251 configured to slide onto a shelf support bracket and an extension connector 252. The securing portion 251 may be made of a semi-flexible material. In such a configuration, the securing portion is preferably flexible enough to allow the securing portion to be easily placed over a shelf support bracket, but rigid enough to grip the support bracket tightly. The extension connector may be configured, for example, to fit within the inner diameter of a hollow or partially-hollow garment rod. One extension clip 250 may be attached to each of two support brackets connected to upright supports, allowing a garment rod or other item to be secured between them. Other extension clip configurations may be used, for example having a hook or loop allowing other items to be connected.

Figure 3A:
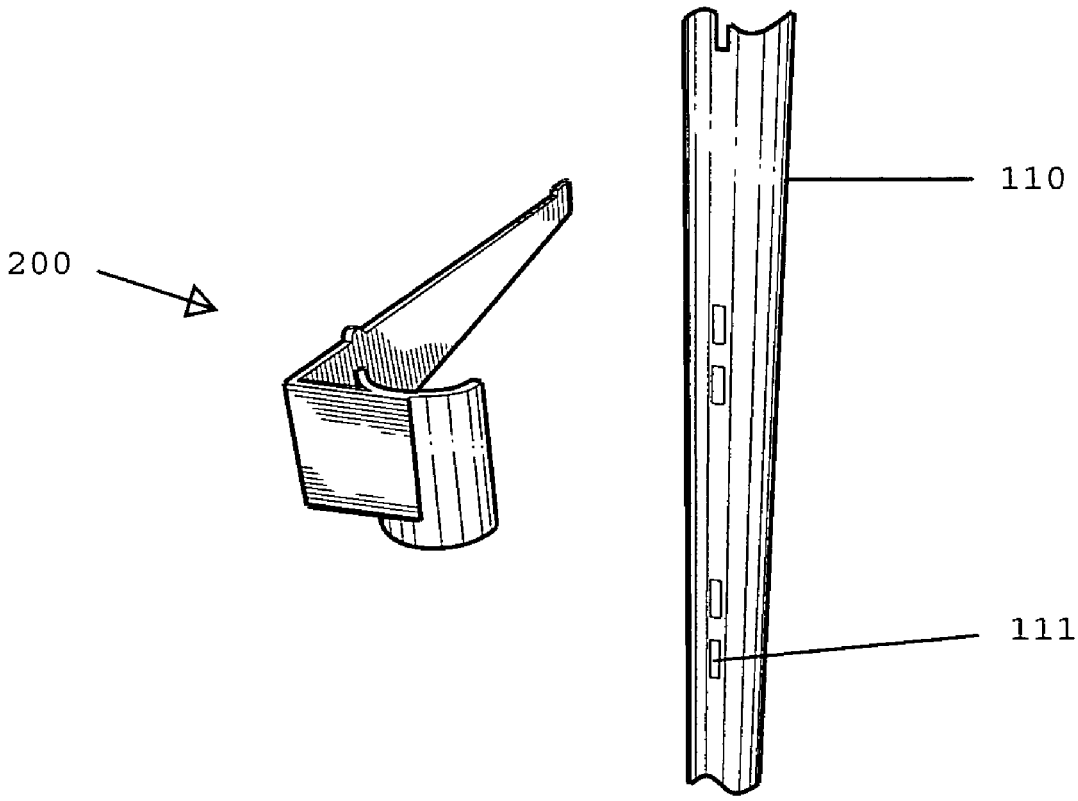
FIG. 3A shows a rear perspective view of a shelf support bracket and an upright support according to an embodiment of the present invention.
Figure 3B:
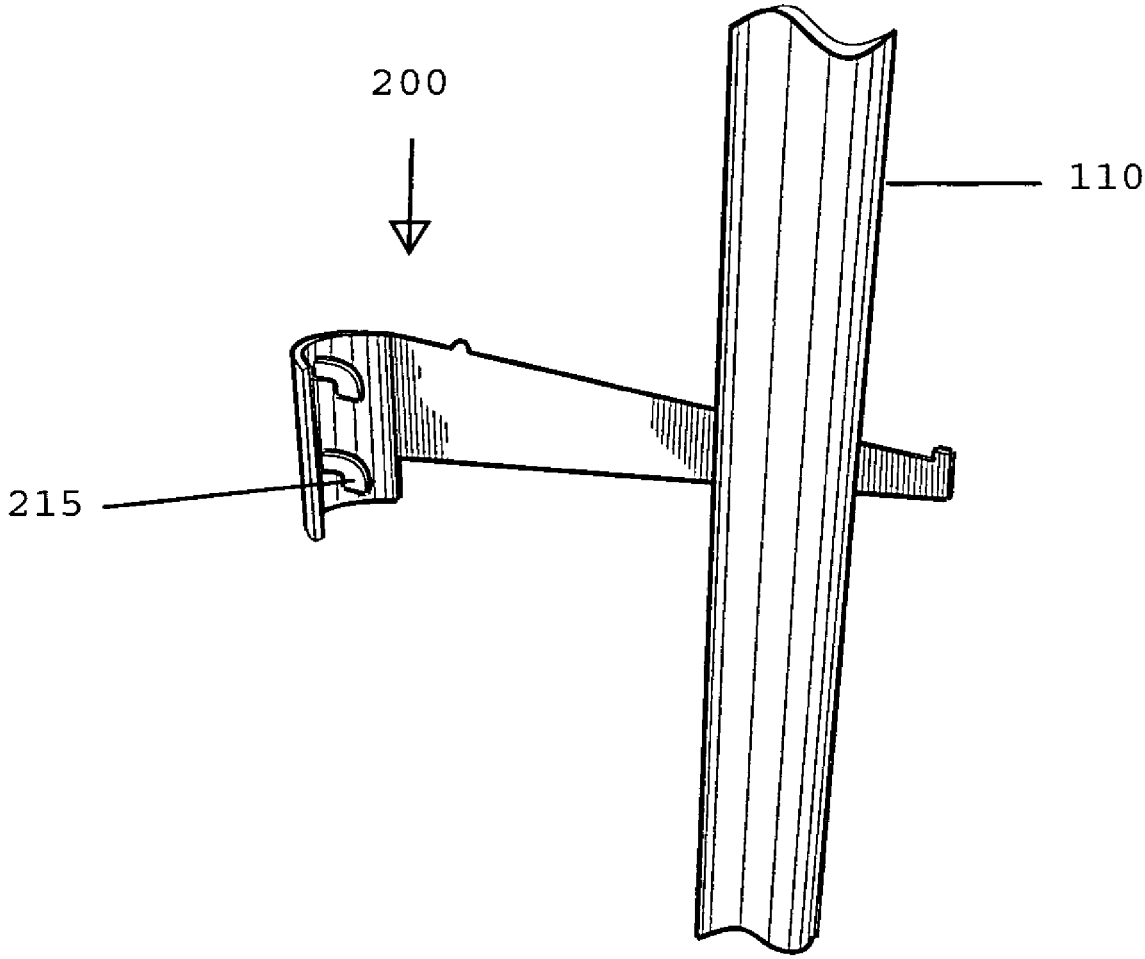
FIG. 3B shows a side perspective view of a shelf support bracket and an upright support according to an embodiment of the present invention.

FIGS. 3A-3B show perspective views of a support bracket 200 disposed near an upright support 110. Each upright support 110 may have a plurality of openings 111 disposed in a line on the rear surface of the upright support, allowing the support bracket to be connected at multiple locations on the upright support. When the support bracket 200 is connected to the upright support, the connection hooks 215 are disposed within corresponding openings 111. Preferably, the connection hooks are configured to have a locked position to prevent separation of the support bracket 200 from the upright support 110. For example, the support bracket 200 shown in FIGS. 3A-3B has connection hooks that are roughly L-shaped. When the support bracket 200 is positioned against an upright support 110 such that the connection hooks 215 are disposed within openings 111, the support bracket may be moved downward. Each connection hooks 215 may then extend below the bottom of the opening 111 within which it is disposed, preventing the support bracket 200 from being removed from the upright support without repositioning the support bracket.

Figure 3C:
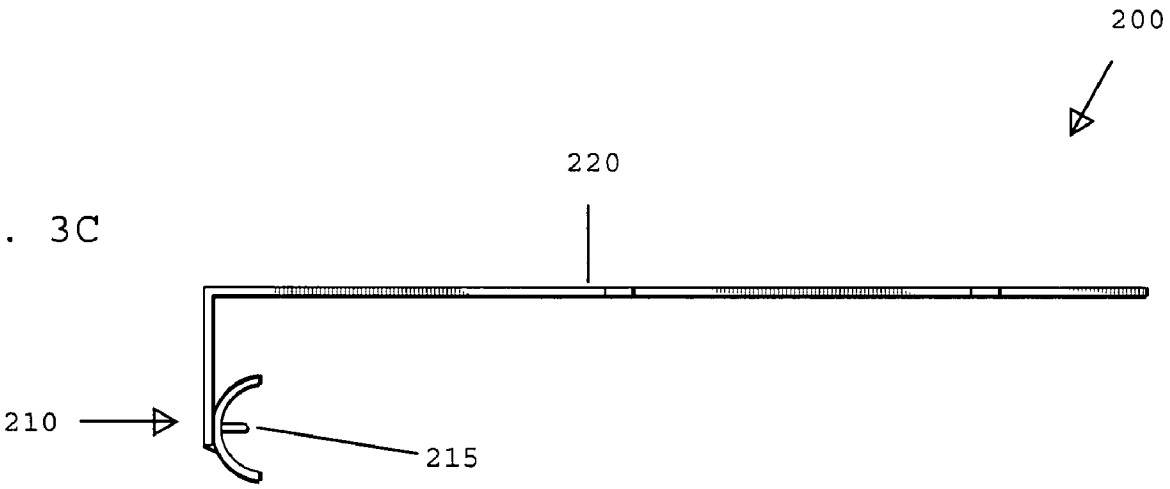
FIG. 3C shows a top view of a shelf support bracket according to an embodiment of the present invention.
Figure 3D:
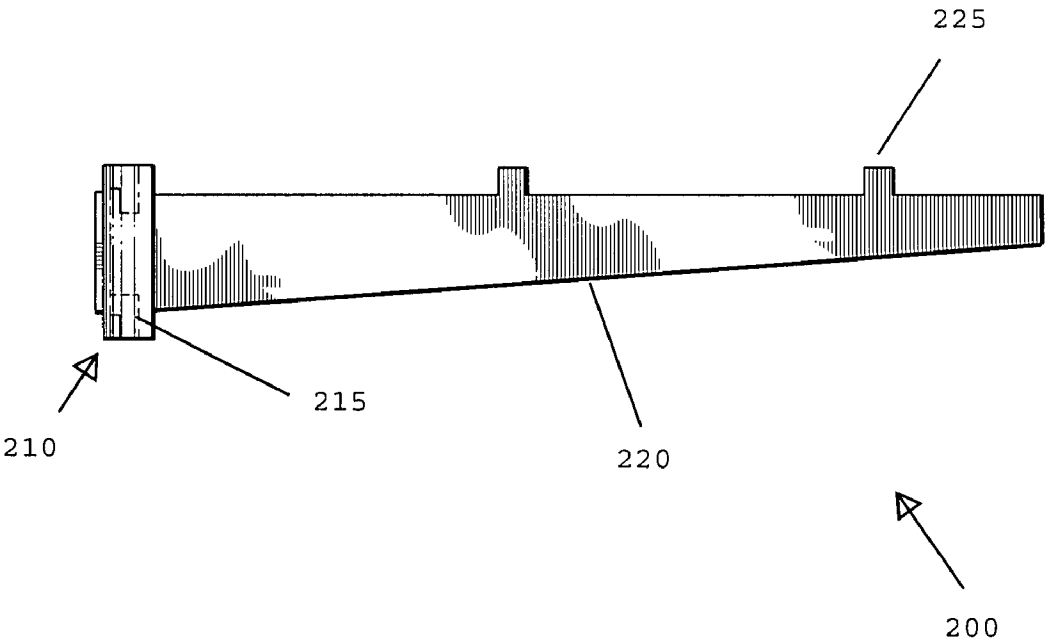
FIG. 3D shows a side vice of a shelf support bracket according to an embodiment of the present invention.

FIG. 3C-3D show top and side views, respectively, of a support bracket 200. The connection hooks 215 may be disposed within the connector 210. A shelf support beam 220 extends from the connector 210. The shelf support beam may be configured such the connector 210 does not intersect a plane defined by the shelf support surface. Protrusions 225 extending from the shelf support beam may be used to secure a shelf to the shelf support surface.

Figure 4:
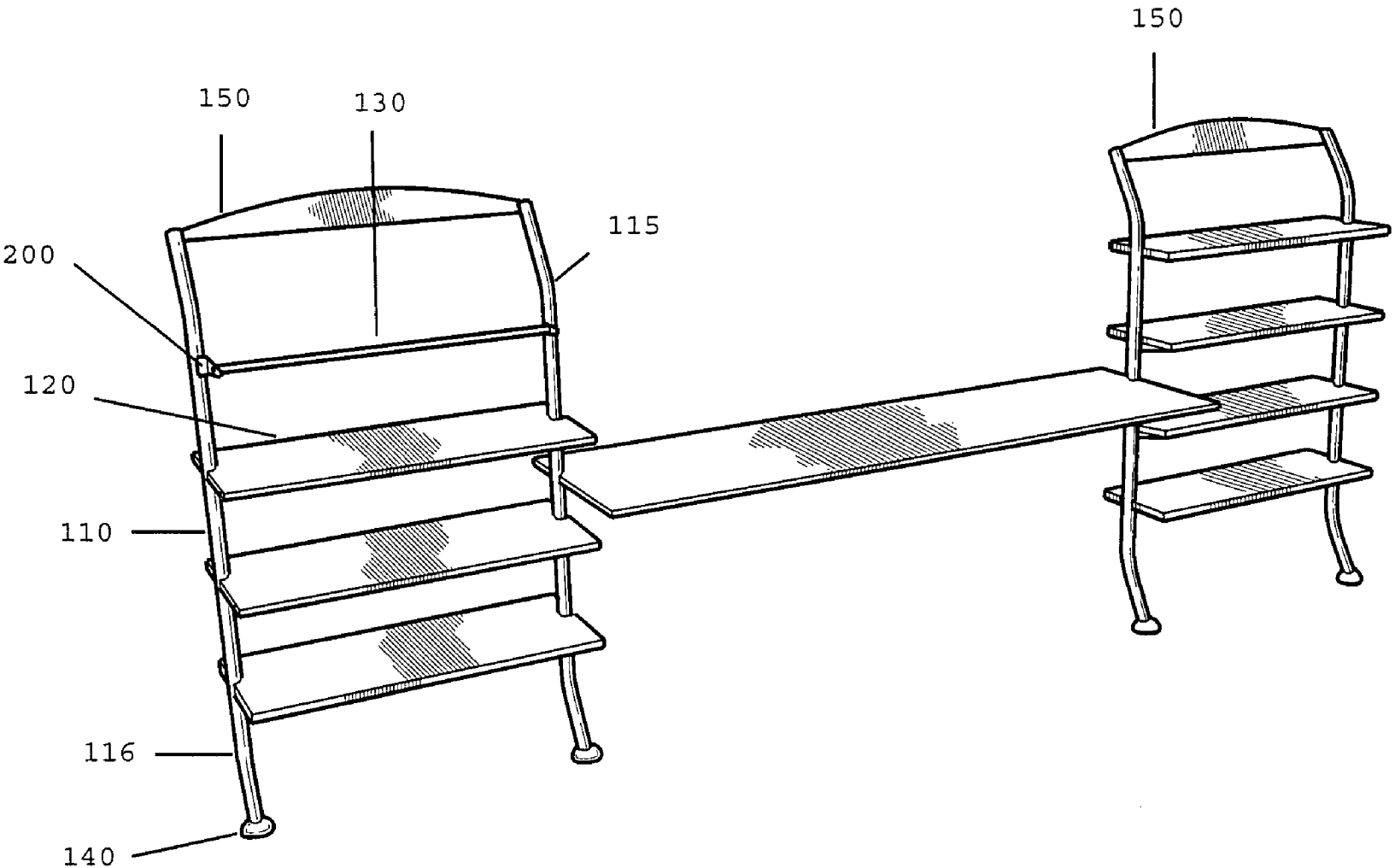
FIG. 4 shows a perspective view of a modular shelf unit with a garment rod according to an embodiment of the present invention.

FIG. 4 shows a shelf unit according to another embodiment of the invention. An arched horizontal member 150 is connected to the upright supports 110. A garment rod 130 is connected to and supported by opposing shelf support brackets 200. Various shelves 120 are disposed between the upright supports 110 and supported by opposing shelf support brackets (not shown). Thus, various shelves and bars can be alternated or switched randomly in the shelving system of the present invention.

Figure 5:
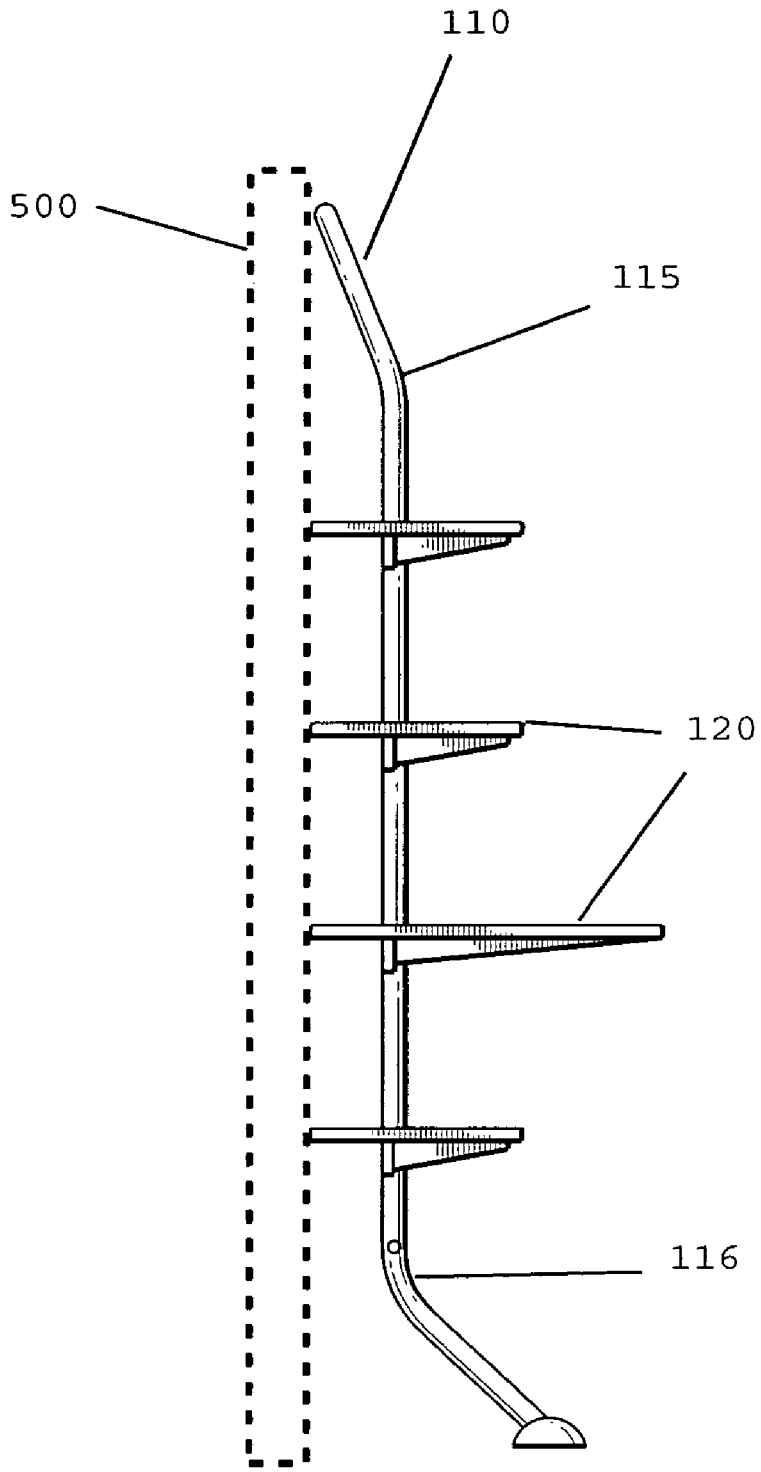
FIG. 5 shows a side view of a modular shelf unit according to an embodiment of the present invention.

FIG. 5 shows a shelf unit according to an embodiment of the invention placed near a wall 500. The top of each upright support 110 contacts the wall 500. In an embodiment, the back edge of one or more of the shelves 120 may also contact the wall to provide additional support to each shelf and/or the unit. Hence, the upper bend 115 of the upright connectors may be configured to match the amount of each shelf 120 that extends beyond the back of the upright supports 110. The bottom portion of each upright support 110 may be disposed toward the front of the unit due to lower bend 116 as previously described.

Figure 6:
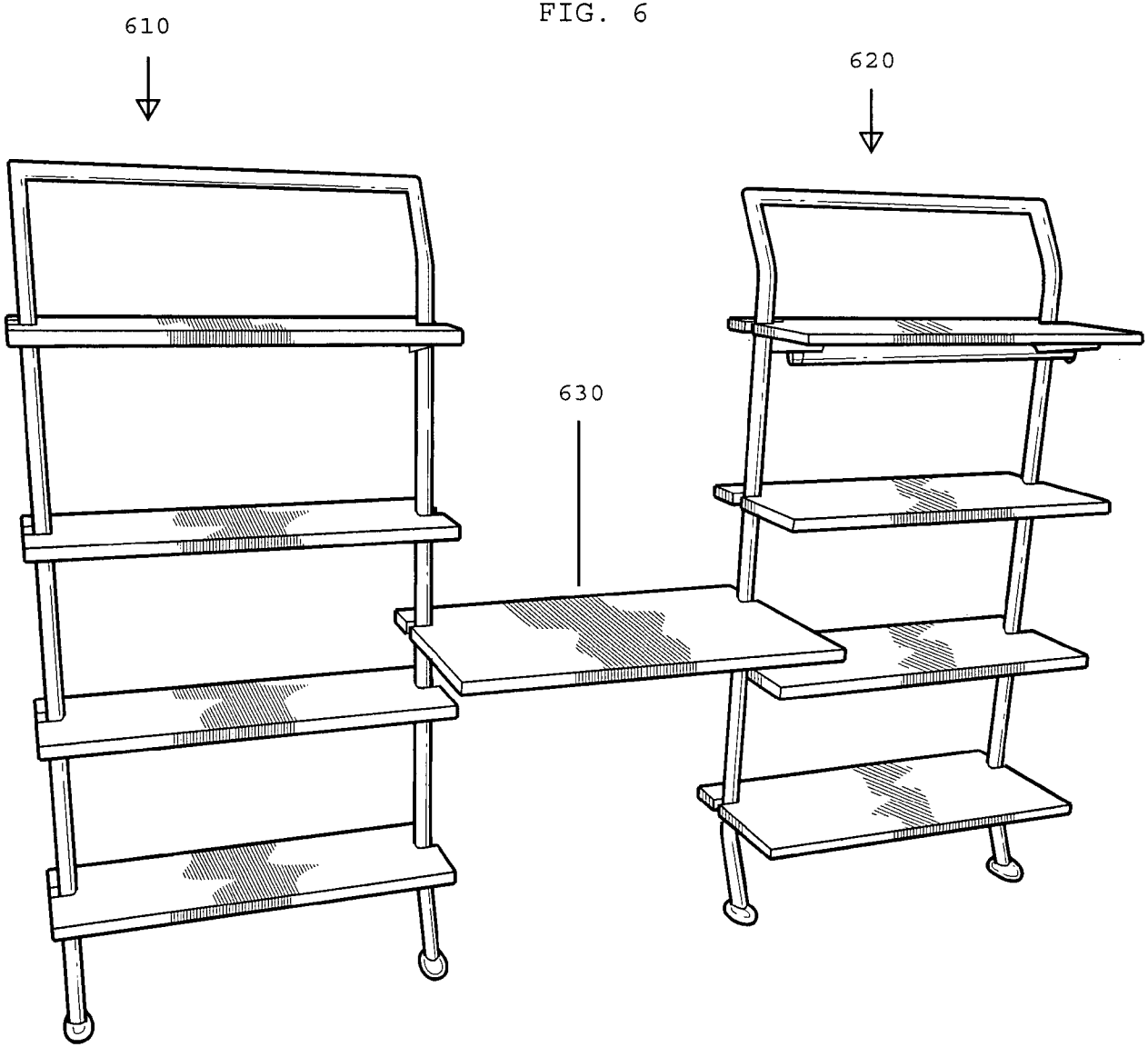
FIG. 6 shows a perspective view of a modular shelf unit according to an embodiment of the present invention.

FIG. 6 shows a modular shelf unit according to another embodiment of the present invention. Each shelf unit 610, 620 is a modular shelf unit similar to the unit 100 described with respect to FIG. 1. The units 610, 620 may have shelves of various sizes as previously described. Each unit 610, 620 may be in a similar configuration, i.e., shelves of the same size and location, or each unit may be configured individually. A connecting shelf 630 may be disposed between the units 610, 620 and supported by shelf support brackets connected to one upright support of each unit. Shelves of various lengths and depths may be disposed between the units 610, 620, and multiple shelves may be used. Similarly, multiple units may be connected via additional shelves.

Figure 7:
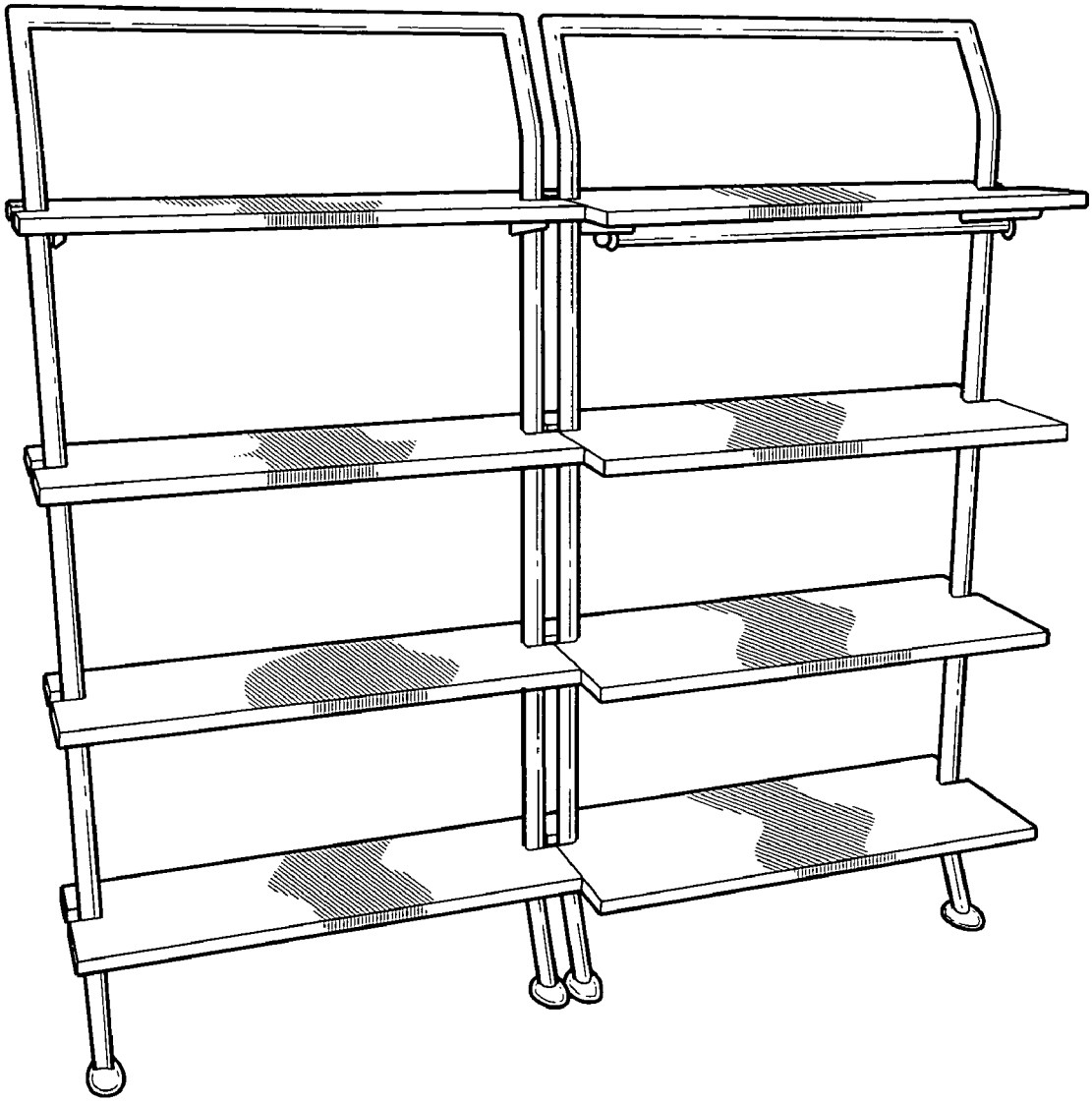
FIG. 7 shows a perspective view of a modular shelf unit according to an embodiment of the present invention.

FIG. 7 is an embodiment of the present invention where four uprights are used. As can be seen in FIG. 7, there are two inner uprights and two outer uprights with the inner uprights being spaced less than a shelve width apart and the outer uprights being spaced two shelve widths apart. This figure shows that numerous configurations of the present invention are plausible.

Figure 8:
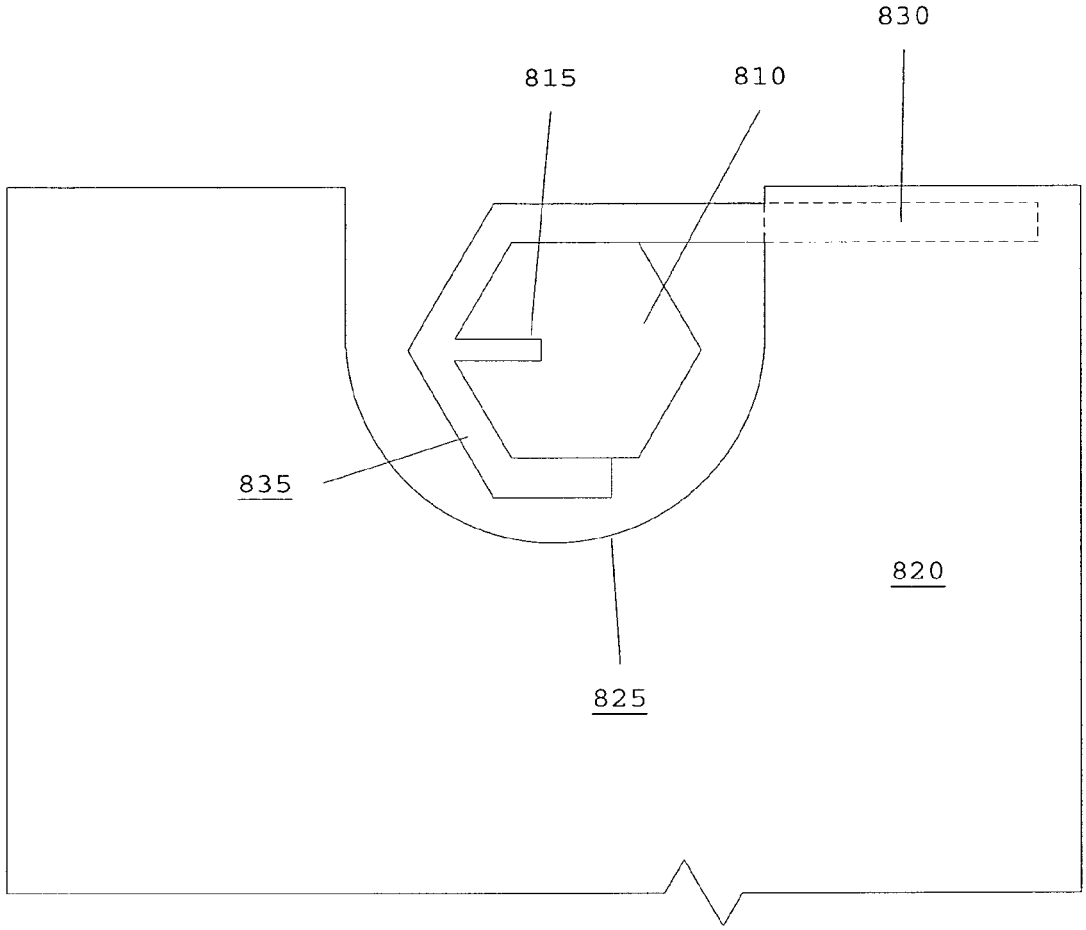
FIG. 8 shows a top view of an upright and shelf support bracket in accord with an embodiment of the present invention.

FIG. 8 shows a top view of an end of a shelf in a shelving system of the present invention. Visible in the figure are a support 810, a support shelf bracket 830, and a shelf 820. As can be seen the shelf 820 has an opening 825 that allows the end of the shelf to extend beyond the support 810 and the bracket 830. As can also be seen, the support has a hexagonal cross-section and the end 835 of the support bracket 830 having the connection hooks 815 is configured to mimic the outside perimeter of the hexagonal support 810. Also evident in this figure is that the support 810 is cantilevered on a single side of the support 810.

Figure 9:
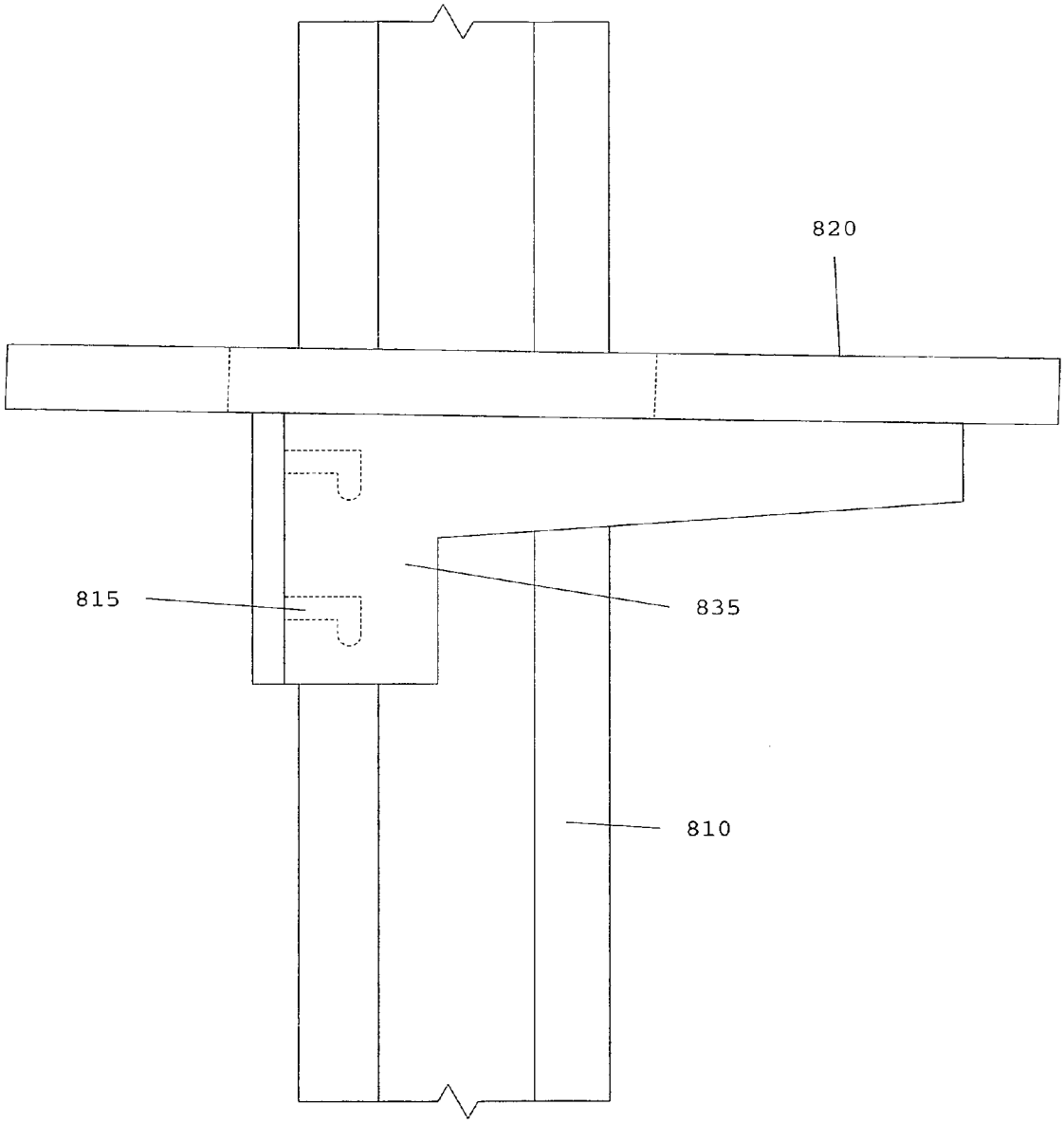
FIG. 9 shows a side view of an upright and shelf support bracket in accord with an embodiment of the present invention.

FIG. 9 shows a side view of the support system shown in FIG. 8. As can be seen in this figure the shelf 820 rests on top of the bracket 830 and the end 835 of the bracket does not extend up over a plane defined by the top of the shelf 820. As can also be seen, the top of the bracket 830 is shown perpendicular to the support 810.

While the present invention is described with respect to particular examples and preferred embodiments, it is understood that the present invention is not limited to these examples and embodiments. For example, many of the materials and structures described herein may be substituted with other materials and structures without deviating from the spirit of the invention. Various configurations of shelves, shelf support brackets, and upright supports may be used to create a variety of shelf configurations. The configurations can include mixed combinations of the various components described herein as well as other components. The present invention as claimed therefore includes variations from the particular examples and preferred embodiments described herein.

What is claimed is:

1. A modular shelving system comprising:

a first upright support having a base, a top end, and an exposed outer perimeter having a plurality of connection openings along its length;

a second upright support having a base, a top end, and an exposed outer perimeter having a plurality of openings along its length, the second upright support spaced a distance apart from the first upright support;

a plurality of shelf supports, each shelf support comprising:

a connector having an inner surface and an outer surface, the inner surface configured to mimic the configuration of at least a portion of the exposed outer perimeter of either or both upright supports;

a plurality of connection hooks extending from the inner surface of the connector, a plurality of the connection hooks positioned and spaced to fit within the openings of the exposed outer perimeter of either upright support, the hooks further configured to have a locked position which prevents the separation of the connector from an upright support when the connector is secured to the upright support; and a shelf support beam having a cantilever end and a shelf support surface, the cantilever end extending from the connector such that when the connector is coupled to an upright support the upright support defines a plane having the cantilever end on one side and the connector on the other side; and a plurality of shelves, each shelf having two openings at opposite ends, the shelves extending beyond the outer perimeter of either or both upright supports in a lateral direction, and resting on shelf support surfaces when the connectors are coupled to the upright supports.

2. The shelving system of claim 1, wherein the shelf support beam is coupled to the connector such that the connector does not intersect a plane defined by the shelf support surface.

3. The shelving system of claim 1, wherein at least one of the plurality of shelves comprises an extension clip detachably disposed on the shelf, the extension clip comprising an extension connector.

4. The shelving system of claim 3, further comprising a garment rod, wherein at least two of the plurality of shelves comprise an extension connector, each extension connector configured to receive an end of the garment rod.

5. The shelving system of claim 1, wherein each of the first and second upright supports further comprises a bend near the top end, wherein the top end is adapted to contact a wall when the upright support is placed a distance from the wall, and wherein the plurality of openings faces the wall when the top end contacts the wall.

6. The shelving system of claim 5, wherein each of the first and second upright supports further comprises a bend near the base, and wherein the base of the upright support is farther from the wall than the upright support when the upright support is placed a distance from the wall.

7. The shelving system of claim 1, wherein each of the plurality of shelves is disposed between the first upright support and the second upright support, each shelf supported by a first of the plurality of shelf supports connected to the first upright support and a second of the plurality of shelf supports connected to the second upright support.

8. The shelving system of claim 1, further comprising a third upright support having a base, a top end, and an exposed outer perimeter having a plurality of openings along its length spaced a distance apart from the second upright support.

9. The shelving system of claim 8, wherein a first of the plurality of shelves is disposed between the second upright support and the third upright support, the first of the plurality of shelves supported by a first of the plurality of shelf supports connected to the second upright support and a second of the plurality of shelf supports connected to the third upright support.

10. The shelving system of claim 9, wherein the first of the plurality of shelves and a second of the plurality of shelves disposed between the second upright support and the third upright support define a continuous surface.

11. The shelving system of claim 1, wherein the shelving system is assembled without the use of hand tools.

12. The shelving system of claim 1, wherein the shelving system is not permanently or removably attached to a wall.

13. The shelving system of claim 1, further comprising a horizontal member having a first end attached to the top end of the first upright support and a second end attached to the top end of the second upright support.

14. The shelving system of claim 1 wherein at least one of the shelves from the plurality of shelves has a depth that exceeds the length of the shelf support beam.

15. A modular shelving system comprising:

a first upright support having a base, a top end, and a cross-section;

a second upright support having a base, a top end, and a cross-section, the second upright support disposed parallel to the first upright support;

a plurality of shelf supports, each shelf support comprising:

a connector having an inner surface and an outer surface, the inner surface approximately equivalent to a surface defined by extruding at least a portion of the cross-section of the first or second upright support in a direction perpendicular to the cross-section;

a plurality of connection hooks disposed within and attached to the connector, each connection hook disposed perpendicular to the inner surface of the connector and parallel to the long axis of the connector;

a first support beam having a first end and a second end, the first end attached to the outer surface of the connector; and a second support beam, the second support beam having a first end attached to the second end of the first support beam and a top edge, wherein the first support beam and the second support beam are perpendicular; and a plurality of shelves, each shelf having two openings at opposite ends;

wherein:

each of the first upright support and the second upright support has a plurality of connection openings along the length of the support;

each of the plurality of shelf supports is removably attached to the first upright support or the second upright support;

each of the connection hooks is disposed within one of the connection openings in the first or second upright support;

each of the plurality of shelves is supported by two of the shelf supports; and each of the plurality of shelves is configured to extend beyond the outer perimeter of the first upright support or the second upright support in a lateral direction and to rest on top of the two of the shelf supports.

16. The shelving system of claim 15, wherein the connectors do not intersect a plane defined by the top edge of the second support beam.

17. The shelving system of claim 15, wherein the shelving system is assembled without the use of tools.

18. The shelving system of claim 15, wherein at least one of the plurality of shelves has a depth that exceeds the length of the support beam.

19. The shelving system of claim 15, wherein each of the plurality of upright supports has a upper bend such that the portion of the upright support above the upper bend is disposed farther toward the back of the plurality of upright supports and a lower bend such that the portion of the upright support below the lower bend is disposed farther toward the front of the plurality of upright supports.

20. The shelving system of claim 15, further comprising a third upright support disposed parallel to the first and second upright supports.

* * * * *

UNITED STATES PATENT AND TRADEMARK OFFICE

CERTIFICATE OF CORRECTION

PATENT NO. : 7,665,619 B2
APPLICATION NO. : 11/519093
DATED : February 23, 2010
INVENTOR(S) : Joy Mangano It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 610 days.

Signed and Sealed this

Seventh Day of December, 2010

David J. Kappos

David J. Kappos
*Director of the United States Patent and Trademark Office*